US007937037B2

(12) United States Patent
Park et al.

(10) Patent No.: US 7,937,037 B2
(45) Date of Patent: May 3, 2011

(54) CLEANING APPARATUS HAVING AN UPPER HOUSING WITH VARIED THICKNESS AND IMAGE FORMING APPARATUS HAVING THE SAME

(75) Inventors: Seung-chan Park, Hwaseong-si (KR); Myoung-su Baek, Swon-si (KR); Soon-seok Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 790 days.

(21) Appl. No.: 11/843,962

(22) Filed: Aug. 23, 2007

(65) Prior Publication Data

US 2008/0240811 A1 Oct. 2, 2008

(30) Foreign Application Priority Data

Mar. 27, 2007 (KR) ..... 10-2007-0029974

(51) Int. Cl.
*G03G 21/12* (2006.01)
*G03G 21/00* (2006.01)

(52) U.S. Cl. ..... 399/360; 399/358

(58) Field of Classification Search ..... 399/344–345, 399/349–351, 358–359, 360
See application file for complete search history.

(56) References Cited

U.S. PATENT DOCUMENTS

| | | | | |
|---|---|---|---|---|
| 2005/0260018 | A1 | 11/2005 | Jang et al. | |
| 2006/0018691 | A1 * | 1/2006 | Baek et al. | 399/358 |
| 2006/0159497 | A1 | 7/2006 | Choi et al. | |
| 2006/0216083 | A1 * | 9/2006 | Okoshi | 399/350 |
| 2007/0041761 | A1 | 2/2007 | Kim | |

FOREIGN PATENT DOCUMENTS

| | | | |
|---|---|---|---|
| JP | 02259683 | A * | 10/1990 |
| JP | 2005227318 | A * | 8/2005 |
| KR | 20060007588 | | 1/2006 |

OTHER PUBLICATIONS

Korean Office Action issued Mar. 2, 2009 in KR Application No. 2007-0029974.

European Search Report dated Jul. 30, 2008 issued in EP 07121915.8.

* cited by examiner

*Primary Examiner* — David M Gray
*Assistant Examiner* — Billy J Lactaoen
(74) *Attorney, Agent, or Firm* — Stanzione & Kim, LLP

(57) ABSTRACT

A cleaning apparatus include a cleaning member to remove a waste toner remaining in a photoconductive medium and a housing to support the cleaning member, including a waste toner admission portion to provide a transfer path of the waste toner removed by the cleaning member, and a waste toner collecting portion to store the waste toner. The housing has a first thickness corresponding to the waste toner admission portion and a second thickness corresponding to the waste toner collecting portion so that the first thickness is smaller than the second thickness.

33 Claims, 4 Drawing Sheets

CLEANING APPARATUS HAVING AN UPPER HOUSING WITH VARIED THICKNESS AND IMAGE FORMING APPARATUS HAVING THE SAME

CROSS-REFERENCE TO RELATED APPLICATIONS

This application claims priority under 35 U.S.C. §119(a) from Korean Patent Application No. 10-2007-0029974, filed on Mar. 27, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, the present general inventive concept relates to a cleaning apparatus having an improved structure to remove waste toner remaining on a photoconductive medium, and an image forming apparatus having the same.

2. Description of the Related Art

A conventional image forming apparatus forms a toner image by applying a toner to a photoconductive medium bearing an electrostatic latent image, and transfers the toner image onto a printing medium. The waste toner remaining on the photoconductive medium is removed by a waste toner cleaning unit, and is collected in a waste toner collecting portion.

If the waste toner is not efficiently transferred, a cleaning performance of the waste toner cleaning unit deteriorates. For example, if the waste toner is removed by a cleaning member from a photoconductive medium but is not completely transferred to the waste toner collecting portion, the waste toner piles up near the cleaning member. This pile of waste toner becomes larger as newly removed waste toner is added to the pile, and occasionally, the waste toner flows backward to the cleaning member. If cleaning performance of the cleaning unit deteriorates, an electrification unit does not electrify the photoconductive medium efficiently, and if a surface of the photoconductive medium is not electrified completely, image contamination such as a stain on an electrostatic latent may occur.

A waste toner transferring apparatus having a rather complicated structure may be employed to efficiently transfer the waste toner. However, the addition of components may interrupt waste toner flow, and also increase the material cost and fabricating process.

SUMMARY OF THE INVENTION

The present general inventive concept provides a cleaning apparatus to transfer smoothly waste toner from a photoconductive medium by improving a structure to prevent a previous removal of the waste toner from obstructing subsequent removals of the waste toner.

The present general inventive concept also provides a cleaning apparatus in which if a large storage image forming apparatus using a waste toner transfer apparatus is applied, function of the waste toner transfer apparatus is improved.

The present general inventive concept also provides an image forming apparatus having a cleaning apparatus applying the above aspects.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a cleaning apparatus usable with an image forming apparatus including a cleaning member to remove a waste toner remaining in a photoconductive medium, and a housing to support the cleaning member, including a waste toner admission portion to provide a transfer path of the waste toner removed by the cleaning member, and a waste toner collecting portion to store the waste toner, wherein the waste toner admission portion having a downstream height in waste toner transfer direction higher than an upper stream height.

A thickness of the housing may be constant, and the cleaning member contacting the photoconductive medium may be inclined downwards in a range from 10° to 20° in the waste toner transfer direction to form a space for the waste toner admission portion.

The housing may have a first thickness corresponding to the waste toner admission portion and a second thickness corresponding to the waste toner collecting portion so that the first thickness is smaller than the second thickness.

A boundary between the first thickness and the second thickness is positioned downstream from the supporting bracket of the cleaning member in the waste toner transfer direction, and the boundary includes an inclined surface.

The cleaning member contacting the photoconductive medium may be inclined downwards in a range from 10° to 20° in the waste toner transfer direction, and the angle (θ) may be 16°.

A portion of the housing corresponding to the waste toner admission portion may be bent upward from a portion corresponding to the waste toner collection portion.

An upper bent portion of the waste toner admission portion may be positioned downstream from a supporting bracket of the cleaning member in the waste toner transfer direction.

A cleaning apparatus may further comprise a waste toner transfer apparatus to convey the waste toner transferred to the waste toner admission portion to the waste toner collecting portion, in addition to a construction of the second exemplary embodiment of the present general inventive concept.

The waste toner transfer apparatus may reciprocate in a substantially perpendicular direction to the waste toner transfer direction.

The foregoing and/or other aspects and utilities of the present general inventive concept may also be achieved by providing an image forming apparatus including a photoconductive medium to form an electrostatic latent image, a developing member to form a toner image by attaching toner onto the electrostatic latent image on the photoconductive medium, and a cleaning apparatus to remove the waste toner which is not transferred from the photoconductive medium to a printing medium from the photoconductive medium.

The image forming apparatus may further include a feeding unit to feed the printing medium to the photoconductive medium, a transfer unit to transfer the toner image on the photoconductive medium onto a printing medium, a fixing unit to fix a toner image by supplying heat and pressure to the printing medium and a discharge to discharge the printing medium bearing the toner image.

The foregoing and/or other aspects and utilities of the present general inventive concept may also be achieved by providing a cleaning apparatus usable with an image forming apparatus, the cleaning apparatus including a cleaning member to remove waste toner from a photoconductive medium, a waste toner collecting portion to collect the waste toner, a waste toner transfer channel having an upper surface and a lower surface to allow the waste toner to flow from the cleaning member to the waste toner collecting portion in a waste toner transfer direction, wherein the lower surface of the waste toner transfer channel declines along the waste toner transfer direction.

The foregoing and/or other aspects and utilities of the present general inventive concept may also be achieved by providing an image forming apparatus, including a frame, and a cleaning apparatus coupled to the frame including a cleaning member to remove waste toner from a photoconductive medium, a waste toner collecting portion to collect the waste toner, a waste toner transfer channel having an upper surface and a lower surface to allow the waste toner to flow from the cleaning member to the waste toner collecting portion in a waste toner transfer direction so that the lower surface of the waste toner transfer channel declines along the waste toner transfer direction.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
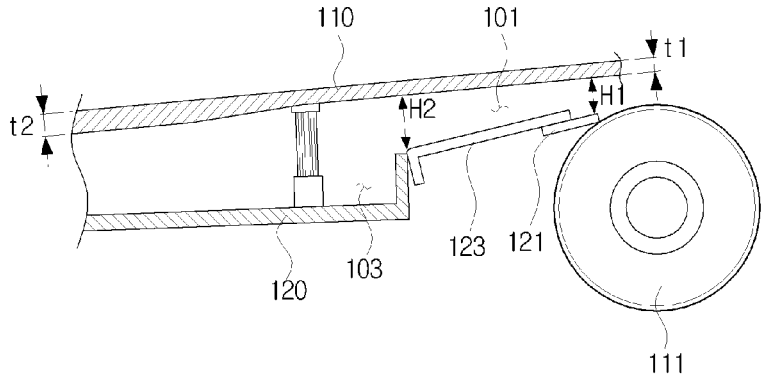
FIG. 1 is an enlarged detail view of a cleaning apparatus according to a first embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
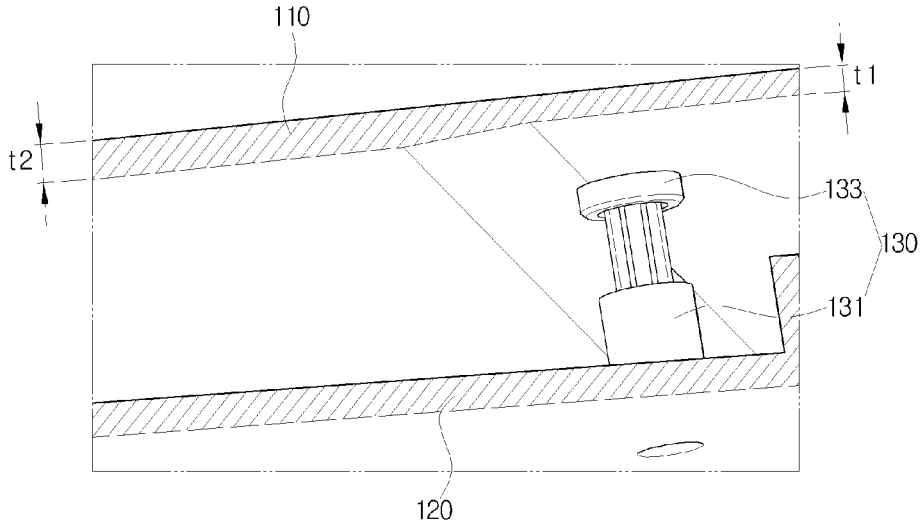
FIG. 2 is a cross-sectional view schematically illustrating a cleaning apparatus according to a second embodiment of the present general inventive concept.
Figure 3:
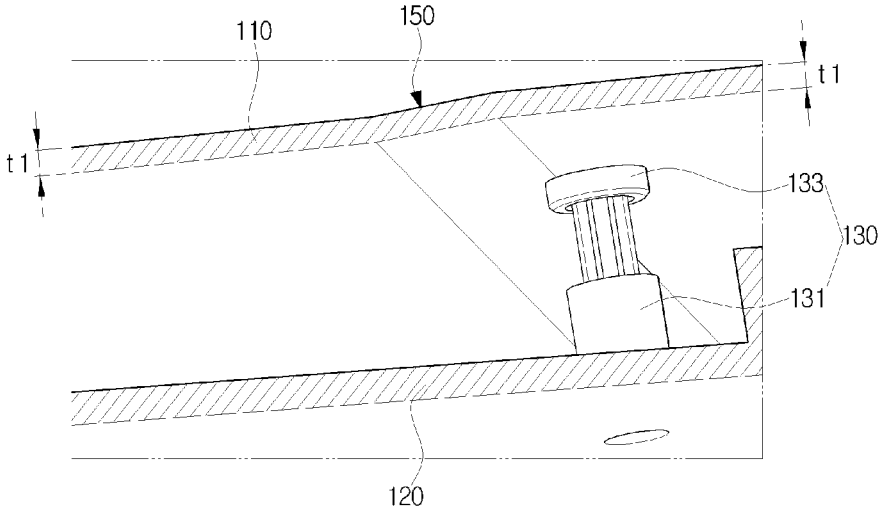
FIG. 3 is an enlarged detail view of a cleaning apparatus according to a third embodiment of the present general inventive concept.

Referring to FIGS. 1 to 3, a housing 100 may increase an upper housing 110 and a lower housing 120, and the upper and lower housings 110 and 120 are assembled by a combining portion 130. A waste toner admission portion 101 in which a cleaning member 121 is disposed, and a waste toner collecting portion 103 which collects waste toner removed by the cleaning member 121, are formed in space formed by the combination of the upper and lower housings 110 and 120.

The waste toner admission portion 101 may be configured such that a downstream height (H2) in a waste toner transfer direction is higher than an upper stream height (H1) to improve performance of the cleaning member 121. The first through third exemplary embodiments of the present general inventive concept describe a structure of the cleaning apparatus which is configured in the above mentioned manner, that is, the structure in which the downstream height (H2) of the waste toner admission portion 101 is higher than upper stream height (H1) in the waste toner transfer direction, and it will be explained below in detail.

In an exemplary embodiment, a photoconductive medium 111 is rotatably disposed proximate to the upper housing 110, and the cleaning member 121 to clean a surface of the photoconductive medium 111 is disposed proximate to the lower housing 120. The cleaning member 121 may be formed in a blade form.

The cleaning member 121 contacts the photoconductive medium 111 at a predetermined angle, and cleans the waste toner that remains on the surface of the photoconductive medium 111, after a toner image is transferred to a recording medium. The cleaning member 121 may be fixed at the lower housing 120 by a supporting bracket 123. The supporting bracket 123 is bent into a substantially '■' configuration, in which one end is fixed to the cleaning member 121 of the blade form, and the other end is fixed at the lower housing 120.

The combining portion 130 may include a protrusion 131 and a groove 133. The combining portion 130 may be disposed near the waste toner collecting portion 103, and the waste toner admission portion 101 may be disposed upstream of the combining portion 130.

Referring to FIG. 1, a thickness (t1) of the upper housing 110 is constant, and the cleaning member 121 contacting the photoconductive medium 111 is inclined at a predetermined angle (θ) (FIG. 4) according to a first exemplary embodiment of the present general inventive concept. The inclined angle (θ) may be in a range from 10° to 20°. In an exemplary embodiment, the angle (θ) is 16°.

As described above, as the inclined angle (θ) of the cleaning member 121 is increased, the downstream height (H2) in the waste toner transfer direction becomes higher than the upper stream height (H1), so that the waste toner in the waste toner admission portion 101 does not form a pile on the cleaning member 121 from a previous removal of waste toner from a photoconductive medium 111, but to scatter and direct the waste toner to the waste toner collecting portion 103 directly.

FIG. 2 is a cross-sectional view schematically illustrating a cleaning apparatus according to a second embodiment of the present general inventive concept.

The first thickness (t1) corresponding to the waste toner admission portion 101 is smaller than the second thickness (t2) corresponding to the waste toner collecting portion 103 in the housing 100 according to an exemplary embodiment of the present general inventive concept as described in FIGS. 2 and 3. The cleaning member 121 is at an inclined angle (θ) with the photoconductive medium 111 as described in the first exemplary embodiment. The first thickness (t1) of the waste toner admission portion 101 is thinner than the second thickness (t2) of the waste toner collecting portion 103 in the housing 100 according to an exemplary embodiment of the present general inventive concept as described in FIGS. 2 and 3. The cleaning member 121 is inclined at an angle (θ) with the photoconductive medium 111 as described in the first exemplary embodiment.

A boundary between the first thickness (t1) and the second thickness (t2) is positioned downstream from the supporting bracket 123 which supports the cleaning member 121 in the waste toner transfer direction. The boundary between the first thickness (t1) and the second thickness (t2) may be inclined, so as not to interrupt a flow of the scattered waste toner.

A length of a portion having the first thickness (t1) of the upper housing 110 is shorter than 50% of an entire length of the upper housing 110, and the housing 100 has more than a standard level of rigidity.

If the thickness of the upper housing 110 is different from the waste toner admission portion 101 and the waste toner collecting portion 103, the waste toner admission portion 101 may be formed in order that the downstream height (H2) is higher than the upper stream height (H1), and a dimension of the waste toner admission portion 101 is increased, without increasing the size of the housing 100. As a result, smooth flow of waste toner from the photoconductive medium 111, through the waste toner admission portion 101 and to the waste toner collecting portion 103, is provided.

Figure 4:
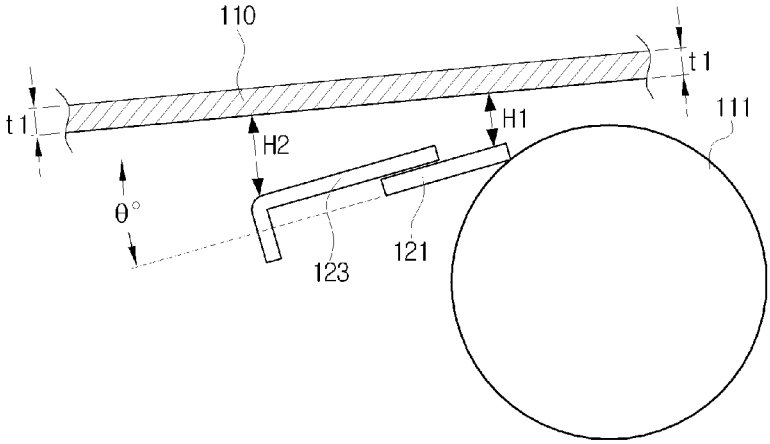
FIG. 4 is an enlarged detail view of FIG. 2.

Referring to FIGS. 3 and 4, a cleaning apparatus according to a third exemplary embodiment of the present general inventive concept having a bent portion 150 instead of the waste toner admission portion 101 and waste toner collecting portion 103 of different thicknesses as described with respect to the second exemplary embodiment.

The bent portion 150 is configured such that a portion corresponding to the waste toner admission portion 101 is bent upward from a portion corresponding to the waste toner collection portion 103. The bent portion 150 is formed downstream in the waste toner transfer direction from the waste toner admission portion 101.

As constructed above, the bent portion 150 may improve a transfer effect of the waste toner similar to that of the upper housing 110 as described with respect to the second exemplary embodiment of the present general inventive concept. Additionally, degradation of strength of the upper housing 110, which may be generated when the thickness of the upper housing 110 varies as described with respect to the second exemplary embodiment of the present general inventive concept, is avoided.

The cleaning member 121 is disposed at an inclined angle (θ) as described with respect to the first and second exemplary embodiments of the present general inventive concepts.

Figure 5:
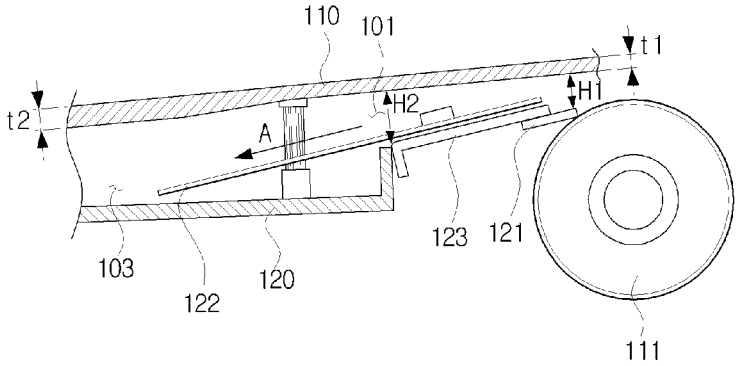
FIG. 5 is a cross-sectional view schematically illustrating a cleaning apparatus according to a fourth embodiment of the present general inventive concept.

Referring to FIG. 5, a cleaning apparatus according to a fourth exemplary embodiment of the present general inventive concept may further include a waste toner transfer member 122 which is disposed at an inclined angle, in addition to the structure as described with respect to the second exemplary embodiment. In an exemplary embodiment, for example, the inclined angle of the waste toner transfer member 122 may be substantially equal to the inclined angle of the cleaning member 121 described above.

The waste toner transfer member 122 is disposed at the upper housing 120 to reciprocate in a substantially perpendicular direction to the waste toner transfer direction A. The waste toner transfer member 122 may be disposed on a waste toner transfer surface of the cleaning member 121, to shatter and convey the removed waste toner to the waste toner collecting portion 103.

The upper housing 110 is configured such that the thickness (t1) at the waste toner admission portion 101 and the thickness (t2) at the waste toner collecting portion 103 are different from each other as described with respect to the second exemplary embodiment of the present general inventive concept. As a result, the removed waste toner is scattered and directed to the waste toner collecting portion 103 according to rotation of the photoconductive medium 111, instead of being piled on the waste toner transfer member 122. Even when the removed waste toner is piled on the waste toner transfer member 122, the waste toner transfer member 122 at the inclined angle is rocked from side to side such that the removed waste toner is shook and transferred. As a result, a tendency of overflow of removed waste toner due to the by accumulation of waste toner on the waste toner transfer surface of the cleaning member 121 is reduced.

Position of the waste toner transfer member 122 is guided by the combination of the protrusion 131 (FIG. 3) and groove 133 (FIG. 3) which may be complementarily disposed at the upper housing 110 and the lower housing 120.

Figure 6:
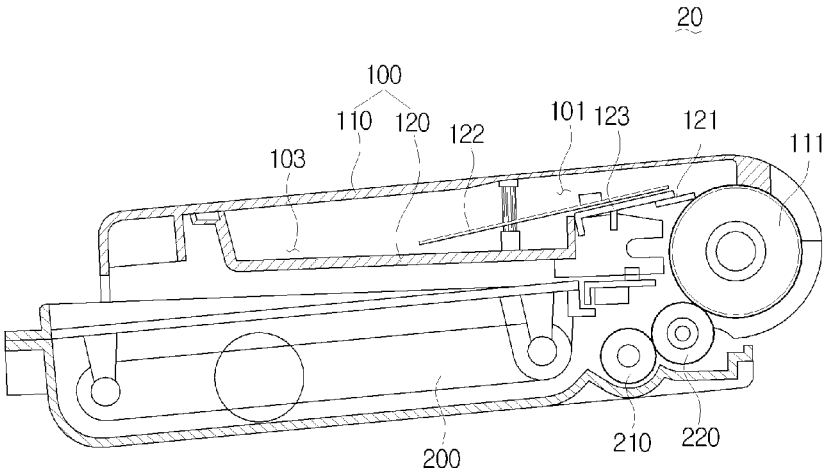
FIG. 6 is a cross-sectional view illustrating a developing unit employing a cleaning apparatus according to an exemplary embodiment of the present general inventive concept.

Referring to FIG. 6, a developing unit 20 of an image forming apparatus having a waste toner cleaning apparatus constructed as the first through fourth exemplary embodiments of the present general inventive concepts, may comprise a housing 100 collecting a waste toner and a toner housing 200 disposed at the bottom of the housing 100.

The housing 100 may be constructed, for example, as described with respect to any of the first through fourth exemplary embodiments of the present general inventive concept. The toner housing 200 may be spaced apart from the housing 100 such that a laser beam of a laser scanning unit 25 (FIG. 7) is passed through a space between the toner housing 200 and the housing 100.

The developing unit 20 may be inclinedly disposed at the image forming apparatus in order that the waste toner collecting portion 103 is positioned at the lower level than the cleaning member 121. If the cleaning member 121 is at the angle of 16° with the photoconductive medium 111, the developing unit 20 may be disposed, for example, at the same angle or greater angle in a range from 16° to 20°.

Accordingly, when the developing unit 20 of the present general inventive concept is applied to a miniature image forming apparatus, it is unnecessary to provide the waste toner transfer unit 122 as described with respect to the first through third exemplary embodiments. As a result, the removed waste toner tends not to pile up on the waste toner transfer surface of the cleaning member 121.

When the developing unit 20 of the present general inventive concept is applied to a large image forming apparatus such as a duplicator, even when a large amount of waste toner is generated, by disposing the waste toner transfer unit 122 as described with respect to the fourth exemplary embodiment of the present general inventive concept, the removed waste toner may be additionally transferred by the rocking of the waste toner transfer member 122. As a result, the waste toner tends not to pile up on the waste toner transfer surface of the cleaning member 121.

Operation of an image forming apparatus including the waste toner cleaning apparatus will be explained according to an exemplary embodiment of the present general inventive concept.

Figure 7:
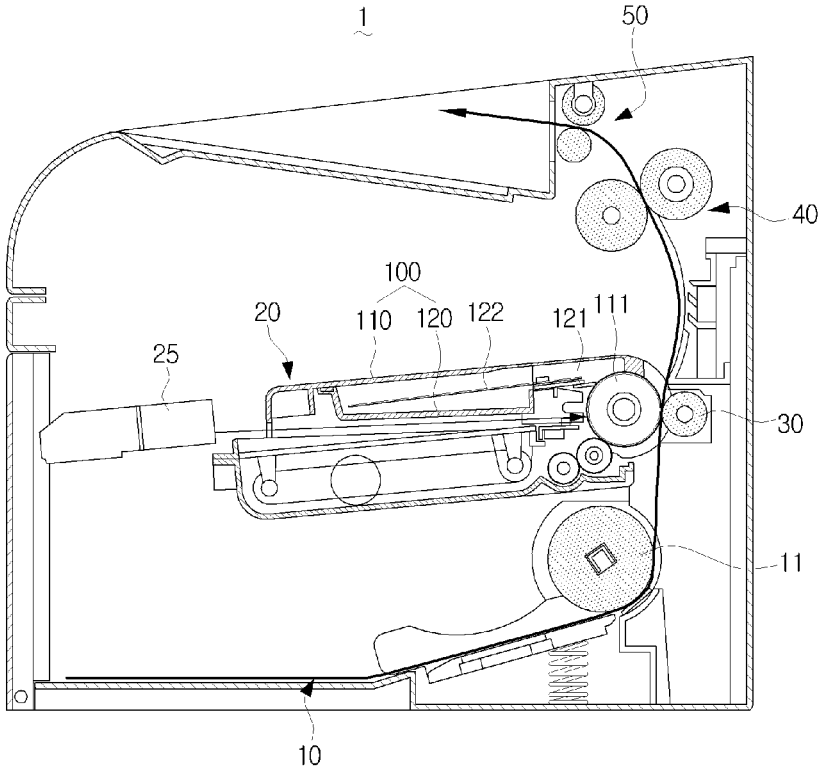
FIG. 7 is a schematic view illustrating an image forming apparatus according to an exemplary embodiment of the present general inventive concept.

Referring to FIG. 7, an image forming apparatus 1 according to an exemplary embodiment of the present general inventive concept may include a feeding unit 10, a developing unit 20, a transfer unit 30, a fixing unit 40, and a discharge unit 50.

If printing starts, sheets of paper put on the feeding unit 10 are transmitted to the developing unit 20 by a pickup unit 11. The laser scanning unit 25 forms print image information with a laser beam, and the laser beam forms an electrostatic latent image on a surface of a photoconductive medium 111. The developing unit 20 forms a toner image by attaching toner onto the electrostatic latent image, and the photoconductive medium 111 transfers the toner image onto a printing medium by rotating while in contact with the transfer unit 30. The printing medium receiving the toner image receives heat and pressure from the fixing unit 40 so that the toner image is fixed on the printing medium. Therefore, printing is completed. The printing medium containing the toner image is discharged outside the image forming apparatus 1 through the discharge unit 50.

Waste toner which is not transferred onto the printing medium in time is removed by the cleaning member 121 from the photoconductive medium 111. The waste toner removed by the cleaning member 121 is pushed and scattered, for example, to the waste toner collecting portion 103 by inertia generated due to rotating force of the photoconductive medium 111. In an exemplary embodiment, even if the waste toner is not scattered due to the waste toner being piled up on the waste toner transfer surface of the cleaning member 121, the waste toner is moved gradually to the waste toner admission portion 101 and the waste toner collecting portion 103 due to the newly added waste toner and an orientation and structure of the waste toner admission portion 101, cleaning member 121 and waste toner collecting portion 103.

As described with respect to the first exemplary embodiment of the present general inventive concept, if the cleaning member 121 is at the angle of 16° with the photoconductive medium 111, downstream of the waste toner admission portion 101 is extended such that the first cleaned waste toner may be scattered far more than in the conventional structure. That is, if the inclined angle is steeply formed at the position where the cleaning member 121 and the photoconductive medium 111 meet, the waste toner removed from the photoconductive medium surface is easily scattered by an air stream generated by rotation of the photoconductive medium 111 downstream of the waste toner admission portion 101 such that the waste toner flies away to the waste toner collecting portion 103 directly. Therefore, the waste toner tends not to or takes longer to pile up on the surface of the cleaning member 121than a conventional structure.

As described with respect to the second and third exemplary embodiments of the present general inventive concept, by positioning the cleaning member 121 at an increased inclined angle, and forming the thickness (t1) of the upper housing 110 at the waste toner admission portion 101 and the thickness (t2) of the lower housing 110 at the waste toner collecting portion 103 at different thicknesses, or by forming a bent portion 150 having a portion corresponding to the waste toner admission portion 101 bent upward from a portion corresponding to the waste toner collecting portion 103, the waste toner admission portion 101 can have a larger opening downstream as compared to upstream in a waste toner transfer direction.

If the downstream opening of the waste toner admission portion 101 is extended wider as compared with the upstream opening of the waste toner admission portion 101, even if the waste toner piles up on the waste toner transfer surface of the cleaning member 121, a period of time point for the previously removed waste toner to obstruct subsequent removal of waste toner is longer than the conventional structure. Therefore, the waste toner scattered at a previous removal may enter deeper into the waste toner collecting portion 103 than a conventional structure.

If the waste toner transfer member 122 is disposed by applying the large image forming apparatus as described with respect to the fourth exemplary embodiment of the present general inventive concept, it is possible to improve a waste toner transfer effect of the waste toner transfer member 122. That is, the developing unit 20 having the housing 20 constructed with a varying thickness is disposed at more than sixteen degrees in order that the waste toner collecting portion 103 is positioned lower than the cleaning member 121. Accordingly, the waste toner tends not to pile up on the waste toner transfer surface of the cleaning member 121 is transferred smoothly to the waste toner collecting portion 103.

According to various embodiments of the present general inventive concept, since a structure to transfer waste toner is improved, the waste toner may be transferred smoothly which is particularly advantageous for the miniature image forming apparatus.

If the present inventive concept is applied to a large storage image forming apparatus using a waste toner transfer apparatus, function of the waste toner transfer apparatus may be improved.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A cleaning apparatus usable with an image forming apparatus, the cleaning apparatus comprising:

a cleaning member to remove waste toner remaining in a photoconductive medium; and a housing to support the cleaning member including a waste toner admission portion to provide a transfer path of the waste toner removed by the cleaning member, and a waste toner collecting portion to store the waste toner, such that an upper housing portion is positioned above the photoconductive medium, the waste toner admission portion, and the waste toner collecting portion, and the upper housing portion above the waste toner admission portion is thinner than the upper housing portion above the waste toner collecting portion;

wherein the waste toner admission portion includes a downstream height in a waste toner transfer direction higher than an upper stream height, wherein the upper housing portion comprises:

a first thickness corresponding to the waste toner admission portion; and a second thickness corresponding to the waste toner collecting portion so that the first thickness is smaller than the second thickness, wherein a boundary between the first thickness and the second thickness is positioned downstream from a supporting bracket of the cleaning member in the waste toner transfer direction.

2. The cleaning apparatus of claim 1, wherein a length of a portion of the housing having the first thickness shorter than 50% of an entire length of the housing.

3. The cleaning apparatus of claim 1, wherein the boundary comprises:

an inclined surface.

4. The cleaning apparatus of claim 1, wherein the cleaning member contacting the photoconductive medium is inclined downwards in a range from 10° to 20° in the waste toner transfer direction.

5. The cleaning apparatus of claim 1, further comprising:

a waste toner transfer apparatus to convey the waste toner transferred to the waste toner admission portion to the waste toner collecting portion.

6. The cleaning apparatus of claim 5, wherein the waste toner transfer apparatus reciprocates in a substantially perpendicular direction to the waste toner transfer direction.

7. The cleaning apparatus of claim 1, wherein a portion of the housing corresponding to the waste toner admission portion is bent upward from a portion corresponding to the waste toner collection portion.

8. The cleaning apparatus of claim 7, wherein an upper bent portion of the waste toner admission portion is positioned downstream from a supporting bracket of the cleaning member in the waste toner transfer direction.

9. The cleaning apparatus of claim 8, wherein the cleaning member contacting the photoconductive medium is inclined downwards in a range from 10° to 20° in the waste toner transfer direction.

10. The cleaning apparatus of claim 7, further comprising:

a waste toner transfer apparatus to convey the waste toner transferred to the waste toner admission portion to the waste toner collecting portion.

11. The cleaning apparatus of claim 10, wherein the waste toner transfer apparatus reciprocates in a substantially perpendicular direction to the waste toner transfer direction.

12. An image forming apparatus, comprising:

a photoconductive medium to form an electrostatic latent image;

a developing member to form a toner image by attaching toner onto the electrostatic latent image on the photoconductive medium; and a cleaning apparatus to remove the waste toner which is not transferred from the photoconductive medium to a printing medium from the photo conductive medium;

wherein the cleaning apparatus comprises:

a cleaning member to remove the waste toner remaining on the photoconductive medium, and a housing to support the cleaning member, including a waste toner admission portion to provide a transfer path of the waste toner removed by the cleaning member, and a waste toner collecting portion to store the waste toner, such that an upper housing portion is positioned above the photoconductive medium, the waste toner admission portion, and the waste toner collecting portion, and the upper housing portion above the waste toner admission portion is thinner than the upper housing portion above the waste toner collecting portion;

wherein the waste toner admission portion is formed having a downstream height higher than an upper stream height, wherein the upper housing portion comprises:

a first thickness corresponding to the waste toner admission portion; and a second thickness corresponding to the waste toner collecting portion so that the first thickness is smaller than the second thickness, wherein a boundary between the first thickness and the second thickness is positioned downstream from a supporting bracket of the cleaning member in the waste toner transfer direction.

13. The image forming apparatus of claim 12, wherein a length of a portion of the housing having the first thickness shorter than 50% of an entire length of the housing.

14. The image forming apparatus of claim 12, wherein the boundary comprises:

an inclined surface.

15. The image forming apparatus of claim 12, wherein the cleaning member contacting the photoconductive medium is inclined downwards in a range from 10° to 20° in the waste toner transfer direction.

16. The image forming apparatus of claim 12, further comprising:

a waste toner transfer apparatus to convey the waste toner transferred to the waste toner admission portion to the waste toner collecting portion.

17. The image forming apparatus of claim 16, wherein the waste toner transfer apparatus reciprocates in a substantially perpendicular direction to the waste toner transfer direction.

18. The image forming apparatus of claim 12, wherein a portion of the housing corresponding to the waste toner admission portion is bent upward from a portion corresponding to the waste toner collection portion.

19. The image forming apparatus of claim 18, wherein an upper bent portion of the waste toner admission portion is positioned lower than a supporting bracket of the cleaning member in the waste toner transfer direction.

20. The image forming apparatus of claim 19, wherein the cleaning member contacting the photoconductive medium is inclined downwards in a range from 10° to 20° in the waste toner transfer direction.

21. The image forming apparatus of claim 18, further comprising:

a waste toner transfer apparatus to convey the waste toner transferred to the waste toner admission portion to the waste toner collecting portion.

22. The image forming apparatus of claim 21, wherein the waste toner transfer apparatus reciprocates in a substantially perpendicular direction to the waste toner transfer direction.

23. An image forming apparatus, comprising:

a photoconductive medium to form an electrostatic latent image;

a developing member to form a toner image by attaching toner onto the electrostatic latent image on the photoconductive medium;

a transfer unit to transfer the toner image on the photoconductive medium onto a printing medium;

a cleaning apparatus to remove the waste toner which is not transferred from the photoconductive medium to a printing medium from the photoconductive medium;

a feeding unit to feed the printing medium to the photoconductive medium;

a fixing unit to fix a toner image by supplying heat and pressure to the printing medium; and a discharge to discharge the printing medium bearing the toner image;

wherein the cleaning apparatus comprises:

a cleaning member to remove waste toner remaining on the photoconductive medium; and a housing to support the cleaning member, including a waste toner admission portion to provide a transfer path of the waste toner removed by the cleaning member, and a waste toner collecting portion to store the waste toner, such that an upper housing portion positioned along an exterior surface of the cleaning apparatus provides a first thickness above the waste toner admission portion and a second thickness above the waste toner collecting portion such that the first thickness is smaller than the second thickness;

wherein the waste toner admission portion having a downstream height in waste toner transfer direction higher than an upper stream height, wherein a boundary between the first thickness and the second thickness is positioned downstream from a supporting bracket of the cleaning member in the waste toner transfer direction.

24. The image forming apparatus of claim 23, wherein a length of a portion of the housing having the first thickness is shorter than 50% of an entire length of the housing.

25. The image forming apparatus of claim 23, wherein the boundary comprises:

an inclined surface.

26. The image forming apparatus of claim 23, wherein the cleaning member contacting the photoconductive medium is inclined downwards in a range from 10° to 20° in the waste toner transfer direction.

27. The image forming apparatus of claim 23, further comprising:

a waste toner transfer apparatus to convey the waste toner transferred to the waste toner admission portion to the waste toner collecting portion.

28. The image forming apparatus of claim 27, wherein the waste toner transfer apparatus reciprocates in a substantially perpendicular direction to the waste toner transfer direction.

29. The image forming apparatus of claim 23, wherein a portion of the housing corresponding to the waste toner admission portion is bent upward from a portion corresponding to the waste toner collection portion.

30. The image forming apparatus of claim 29, wherein an upper bent portion of the waste toner admission portion is downstream from a supporting bracket of the cleaning member in the waste toner transfer direction.

31. The image forming apparatus of claim 30, wherein the cleaning member contacting the photoconductive medium is inclined downwards in a range from 10° to 20° in the waste toner transfer direction.

32. The image forming apparatus of claim 29, further comprising:

a waste toner transfer apparatus to convey the waste toner transferred to the waste toner admission portion to the waste toner collecting portion.

33. The image forming apparatus of claim 32, wherein the waste toner transfer apparatus reciprocates in a substantially perpendicular direction to the waste toner transfer direction.

* * * * *